US007267615B2

(12) United States Patent
Rodden et al.

(10) Patent No.: US 7,267,615 B2
(45) Date of Patent: Sep. 11, 2007

(54) VIDEO GAME

(75) Inventors: Anthony Ian Rodden, Birmingham (GB); Paul Daniel Smith, Coventry (GB)

(73) Assignee: Red Gaming Limited, Lancs (GB)

( * ) Notice: Subject to any disclaimer, the term of this patent is extended or adjusted under 35 U.S.C. 154(b) by 0 days.

(21) Appl. No.: 09/999,416

(22) Filed: Nov. 1, 2001

(65) Prior Publication Data

US 2002/0098880 A1 Jul. 25, 2002

(30) Foreign Application Priority Data

Nov. 7, 2000 (GB) ..... 0027362.3

(51) Int. Cl.
*A63F 9/24* (2006.01)

(52) U.S. Cl. ..... 463/30; 273/138.3

(58) Field of Classification Search ..... 273/138.2, 273/138.3, 118 R–121 R, 120 A, 121 A, 273/121 B, 121 D, 121 E, 122 A, 126 R, 273/126 A; 463/3, 1, 36–38, 2
See application file for complete search history.

(56) References Cited

U.S. PATENT DOCUMENTS

| | | | | |
|---|---|---|---|---|
| 4,496,160 | A | 1/1985 | Wichinsky et al. | |
| 4,504,055 | A | 3/1985 | Wells | |
| 4,662,636 | A | 5/1987 | Crompton | |
| 4,770,415 | A | 9/1988 | Evans et al. | |
| 5,016,879 | A * | 5/1991 | Parker et al. | 273/126 A |
| 5,022,653 | A * | 6/1991 | Suttle et al. | 463/13 |
| 5,120,060 | A * | 6/1992 | Parker et al. | 280/788 |
| 5,435,554 | A | 7/1995 | Lipson | |
| 5,507,490 | A | 4/1996 | Hagiwara | |
| 5,611,731 | A * | 3/1997 | Bouton et al. | 463/37 |
| 5,700,193 | A * | 12/1997 | d'Achard Van Enschut | 463/3 |
| 5,752,699 | A * | 5/1998 | Crompton et al. | 273/138.2 |
| 5,775,691 | A * | 7/1998 | Hamano | 607/9 |
| 5,788,573 | A * | 8/1998 | Baerlocher et al. | 463/16 |
| 5,836,819 | A * | 11/1998 | Ugawa | 463/30 |
| 5,951,009 | A * | 9/1999 | Miyamoto et al. | 273/121 B |
| 5,951,397 | A * | 9/1999 | Dickinson | 463/36 |
| 6,117,009 | A | 9/2000 | Yoseloff | |
| 6,279,904 | B1 * | 8/2001 | Huang | 273/121 R |
| 6,296,568 | B1 * | 10/2001 | Tracy | 463/17 |
| 2002/0094856 | A1 * | 7/2002 | Bennett et al. | 463/16 |

FOREIGN PATENT DOCUMENTS

| | | |
|---|---|---|
| EP | 0 859 344 A1 | 2/1997 |
| EP | 0 769 769 A1 | 4/1997 |
| EP | 0 945 837 A2 | 3/1999 |
| GB | 2 124 913 | 2/1983 |

(Continued)

*Primary Examiner*—Robert E. Pezzuto
*Assistant Examiner*—Alex F. R. P. Rada, II
(74) *Attorney, Agent, or Firm*—George H. Gerstman; Seyfarth Shaw LLP

(57) ABSTRACT

A coin-operated video game machine has a VDU (4) and player controls, such as push buttons (9). In play of a game the screen shows a representation of coins rolling down a run (22) to fall through a fall zone (24), in which the trajectory of fall is influenced by protruding pins (25), onto a bed (14) across which a pusher (27) moves. The player can influence the movement of the coins which fall with trajectories in accordance with gravity and the laws of physics. An award is attained whenever a coin is pushed off the bed (14) into an outlet (6).

24 Claims, 1 Drawing Sheet

FOREIGN PATENT DOCUMENTS

| | | | | |
|---|---|---|---|---|
| GB | 2 226 766 | | | 7/1990 |
| GB | 2 292 693 | | | 3/1996 |
| GB | 2 320 443 | A | | 6/1998 |
| GB | 2 338 578 | | | 12/1999 |
| JP | 09313732 | A | * | 12/1997 |
| JP | 2000126442 | A | * | 5/2000 |
| WO | WO96/33471 | | | 10/1996 |
| WO | WO98/17360 | | | 4/1998 |
| WO | WO99/10849 | | | 3/1999 |
| WO | WO 00/30727 | | | 6/2000 |

* cited by examiner

VIDEO GAME

This invention relates to a coin-operated video game machine. The term coin is used herein to cover coins, tokens, notes, cash cards, credit cards, loyalty cards and any other means of providing credit or monetary value.

A well known mechanical game machine of the 'coin pusher' kind has a pusher which moves backwards and forwards at the rear part of a flat horizontal playing bed within a windowed enclosure. Multiple side by side coin slots are provided in the enclosure, at the top of a fall zone. Positioned within the fall zone are protruding pins which deflect inserted coins as they fall onto the bed. The pusher acts to push coins on the bed towards a front edge of the bed from where they can drop into a pay-out outlet. In use, coins stack up on the bed respectively, and by selection of the slots players seek to cause coins to drop onto the bed in the best position to achieve displacement of the maximum number of coins into the pay-out slot. The actual result is dependent inter alia on the timing and positioning of coin discharge in relation to the deflection action of the pins and the cycle of movement of the pusher element.

With this known mechanical game machine much entertainment and interest is derived from the exercise of skill in the timing and positioning of coin drop and also in the variable and often unexpected nature of the pay-out attainable following a successful coin drop, the magnitude of such pay-out being determined by the extent of stacking of the coins which are displaced by the pusher.

An object of the present invention is to provide a coin-operated video game machine capable of affording entertainment and interest similar to the known mechanical 'coin-pusher' game machine.

According to the invention therefore there is provided a coin-operated video game machine having a visual display device, a control unit and player controls, wherein after actuation by introduction of predetermined credit or monetary value the machine is operable to produce a representation, on the visual display device, of an introduced element falling from an upper inlet to a position on a lower playing bed having further elements thereon, and of a pusher movable over the playing bed to cause the introduced element and the further elements to be pushed towards a pay-out outlet, wherein by operation of the player controls at least one parameter of fall of the introduced element can be adjusted and, in the event that the said position of the introduced element in relation to the further elements is such as to give rise to a representation of one or more said elements reaching said pay-out outlet, an award is made available to the player.

With this arrangement, the video game machine can simulate the known mechanical 'coin-pusher' machine and can provide comparable entertainment and interest in so far as the player can exercise skills which may be perceived to be similar to the mechanical machine and also in so far as awards of a variable or unexpected nature can be made available determined by the number of elements reaching the simulated pay-out outlet.

The player controls may be of any suitable kind or combination of kinds and thus may comprise push buttons and/or a touch screen or the like.

In simulation of the known mechanical game, the player controls may be usable to adjust the timing and/or possibly the trajectory of fall of the introduced element. Conveniently there may be a plurality of slots or a single slot in combination with transverse movement of a coin run having a discharge end or other arrangement from which the introduced element falls and the player may have the capability of influencing the position of introduction of the element and/or the instant, in relation to movement of the pusher, at which the introduced element starts to fall. Furthermore, they may be a fall zone positioned perpendicular to the playing bed through which the introduced coin falls, it's trajectory being influenced by a series of protruding pins, positioned randomly or pseudo randomly throughout the fall zone, from which the introduced coin is deflected.

Preferably, at least one and preferably all of the movements occurring on the visual display device, i.e. the fall of the introduced element, the trajectory of fall of the element and the pushing of the elements on the playing bed, are computed and displayed on a simulated real life basis. Thus, in relation to the fall of the introduced element, the time of release can be identified whereby a trajectory of movement influenced by the protruding pins of the fall zone and a position of impact on the playing bed in relation to the position of the pusher can be computed in accordance with normal considerations of gravity and the laws of physics and the corresponding movement of the element to such position can then be displayed. In relation to the pushing of the elements, their relative geometrical positions and the direction and distance of movement of the pusher can be identified whereby a displacement of the elements can be computed and displayed in accordance with the laws of physics.

Most preferably, at least during play of a game, the pusher is moved backwards and forwards relative to the pay-out outlet, preferably on a continuous basis.

The elements are preferably flat elements of the nature of coins whereby the falling element may be represented face-on whereas elements on the playing bed may be represented face-down or edge-on or in three-dimensional perspective from above, or otherwise as desired.

The award made available to the player following a winning outcome may be of any suitable kind and thus may be a pay-out of coins, an accumulation of credit or points, or other prize or the like.

Other features may be incorporated as desired whereby on a predictable or random or pseudo random (i.e. influenced or biassed randomness), the player may be given the opportunity of influencing an unsuccessful fall e.g. by moving the introduced element on the playing bed, or an additional free play may be made available or a win not derived from successful positioning may be awarded, or otherwise.

Other different games may also be made available on the same machine, accessed by transition from a predetermined stage in the coin-pusher game or selectably by the player or otherwise.

The video display device may comprise a CRT or LCD screen device or any other suitable device.

The control unit may be a programmed microprocessor unit.

The machine may have a coin-mechanism for credit actuation of any suitable kind.

The machine may have a floor-standing housing of any suitable kind.

The invention will now be described further by way of example only and with reference to the accompanying drawings in which.

Figure 1:
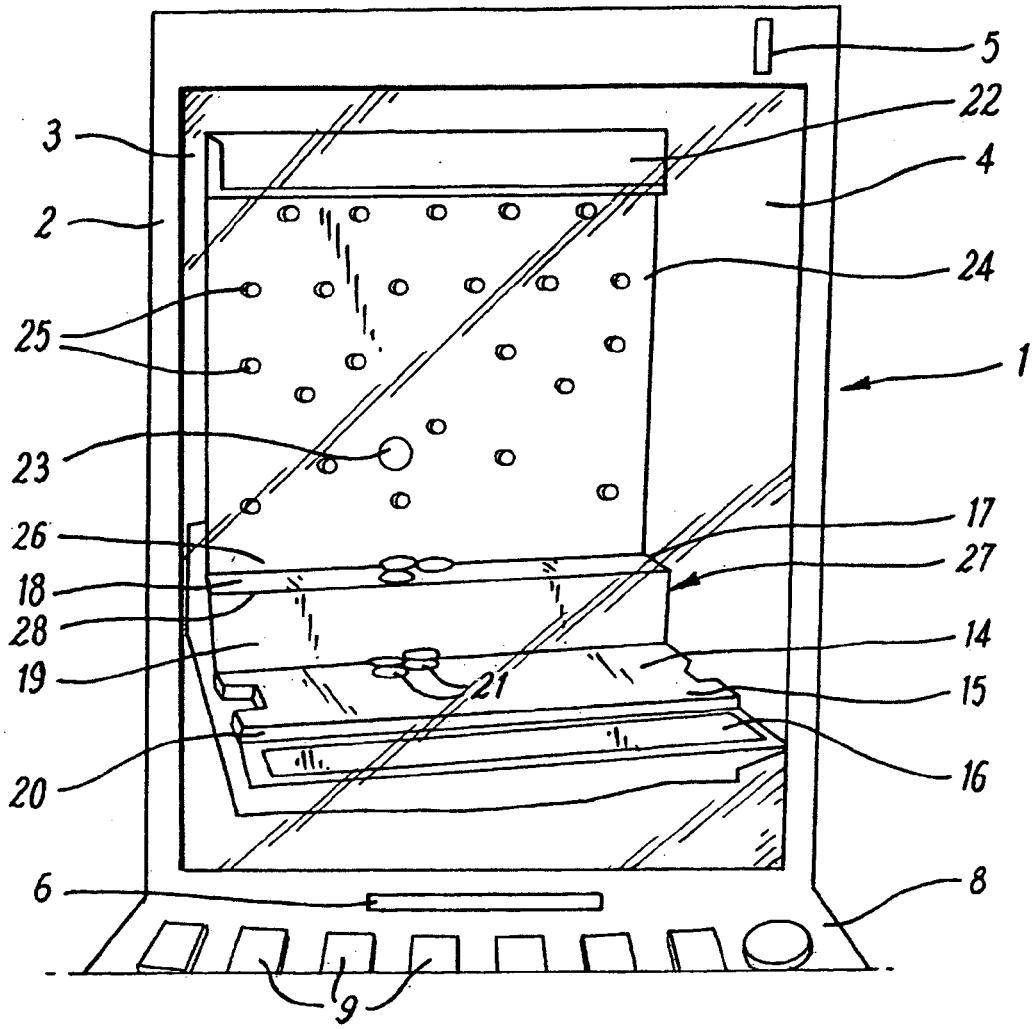
FIG. 1 is a front view of part of one form of a machine according to the invention showing a view of a screen display of the machine.
Figure 2:
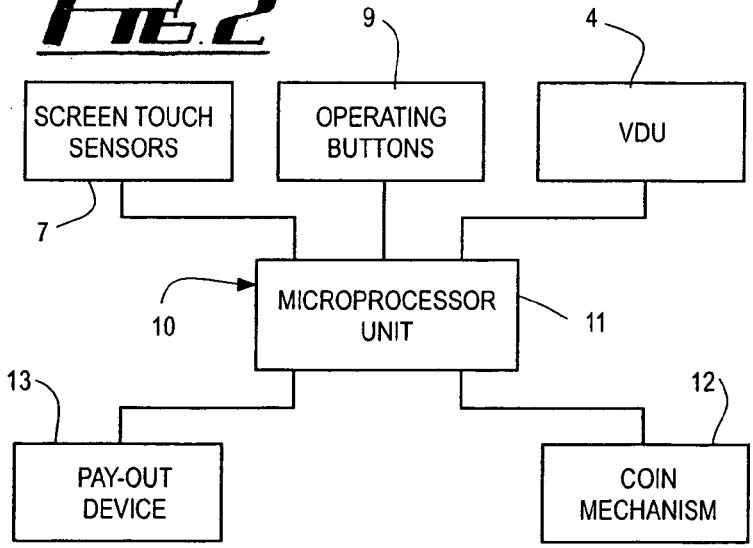
FIG. 2 is a block circuit diagram of the machine.

Referring to the drawings, FIG. 1, shows part of a floor standing cabinet 1 having an upper front wall structure 2 in which is set a video screen 3 of a VDU 4 (CRT or LCD) a coin slot 5 and a pay-out outlet tray 6.

The video screen 3 has touch sensors 7.

There is also a lower panel 8 which houses operating buttons 9.

Within the cabinet 1 there is a control unit 10 comprising a microprocessor unit 11 connected to a coin-mechanism 12 arranged to receive coins from the slot 5, the VDU 4, the screen touch sensors 7, the operating buttons 9, and a pay-out device 13 linked to the pay-out outlet tray 6.

In use, the machine is actuated for play of a game by insertion of coins into the coin-mechanism 12 to a predetermined game play credit value.

The VDU 4 produces a graphic display of a flat playing bed 14 having an inner edge region 15 leading to a pay-out outlet 16.

There is a second raised region 17 comprising a flat area 18 and a front face 19 which together form a pusher 27 which slides repeatedly forwards and backwards over and in contact with the upper surface of the playing bed 14 relative to the inner edge 15. The movement may be of the nature of an angular sweep or rectilinear reciprocal movement or otherwise as desired.

On the upper surface of the playing bed 14 between the front face 19 of the raised region and the free edge 20 of the inner edge region 15 there are multiple flat circular discs 21 of the same or different kinds, preferably identical, distributed randomly or in a predetermined pattern, so as to be edge to edge and/or overlapping and/or stacked in any suitable combinations.

In an upper region of the screen there is a graphic representation of a fall zone 24 positioned perpendicular to the flat area 18 of the raised region 17, along the top horizontal edge of the fall zone 24 is a graphic representation of a coin run 22.

After introduction of sufficient game play credit, a graphic representation of an introduced coin 23, identical to the existing coins 21 on the playing bed 14, can be seen in the coin run 22, such coin 23 being shown vertical or face on to the VDU.

The player now has to use his judgement in deciding at what point the introduced coin 23 is released into the fall zone 24 as the coin run 22 moves transversely from side to side relative to the fall zone 24. This can be done by touching the screen 3 to operate the touch sensors 7. This phase may be timed so that the release opportunity lapses after a predetermined time.

This causes the coin 23 to leave the coin run 22 and enter the fall zone 24 whereupon the coin falls downwardly, it's route being guided by a series of graphically represented protruding pins 25, onto the flat area 18 of the raised region 17 there beneath, and possibly bounce, then fall flat onto the flat area 18, directly onto the flat area 18 or overlapping or stacked on top of any coin or coins 23 already occupying that position on the flat area 18. The direction in which the coin 23 is deflected following collision with protruding pin 25 may be determined either on a random or pseudo random basis or on a computed basis whereby the control unit 10 utilises parameters such as the position of release of the coin 23 from the coin run 22 and the position of the coins centre of gravity when it collides with the pin 25 to determine the route which the coin follows after colliding with a pin 25.

Figure 3:
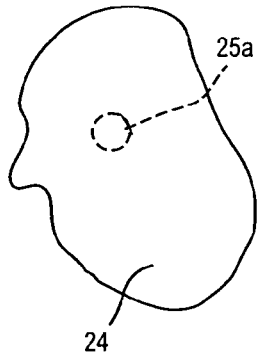
FIG. 3 is an enlarged, fragmentary portion of the front view of FIG. 1, showing how a pin of the virtual image can be retracted.

The player may have the opportunity to influence the route of the coin 23 through the fall zone 24 by touching the protruding pins 25 on the VDU screen 3. This causes the pins to be retracted thereby eliminating any deflection of the coin 23 which might otherwise occur. This is illustrated in FIG. 3, showing how the image of pin 25*a* is in retracted condition relative to the wall defining fall zone 24, after the player has touched the image of pin 25*a*.

The introduced coin 23 takes up a position on the flat area 18 where it will be engaged by the bottom region 26 of the fall zone 24 as the raised region 17 moves backwards, the coin will be pushed forwards by the bottom region 26 of the fall zone 24. If there is a row of aligned edge to edge coins 21 between the introduced coin 23 and the free edge 28, the result will be that a number of coins 21 will fall over the edge 28 onto the playing bed 14. As the raised region 17 then moves forwards the newly fallen coins will engage with it's front face 19 thereby being pushed forwards. If there is a row of aligned edge to edge coins 21 between the newly fallen coins and the free edge 20, the result will be that a number of coins 21 will fall over the edge 15 into the pay-out outlet 16, and this triggers award of a corresponding prize to the player which may be a pay-out through the opening 6 of a corresponding number or value of coins, or may be an addition to a 'bank' which the player can use to credit further games or take as a pay-out as and when desired.

If, as will tend to happen in most cases, there is no aligned row of edge to edge coins 21 between the introduced/newly fallen coins 23 and the free edges 28 and 15 respectively, the action of the pusher will be to deflect the introduced/newly fallen coins and/or one or more of the other coins 21 between the introduced/newly fallen coins and the free edges 28 and 15 so that the coins 18 become overlapped or stacked to a greater degree and no coins 21 are displaced into the pay-out chute 16.

The above mentioned movements of the falling introduced coins 23 the pusher 27 and the existing coins 21 on the flat area 17 and the playing bed 14 respectively are all computed and displayed on a real-life basis. That is, the control unit 10 is programmed with data representing parameters such as the height of the coin run 22, the position and instant of release of the coin 23 from the run 22, the centre of gravity of the coin 23 as it collides with a pin 25, the movement cycle of the pusher, the relative angular positions of the existing coins 21 on the playing bed 14 and flat area 17 respectively whereby the movements take place as far as possible identical with the movements which would occur in a mechanical machine as a consequence of gravity, applied pushing forces and contact geometry of coins 21 of a particular size.

Accordingly, the player can exercise skill in like manner to a mechanical machine and can derive much entertainment and interest from this.

However, the control unit 10 influences the overall progression of the game with the machine being programmed to pay-out a pre-determined percentage of the value of the introduced credit.

On first play, the layout of coins 21 on the playing bed 14 and flat area 17 respectively are generated in a predetermined or random or pseudo random manner. With subsequent games the layout may be modified, and the modifications carried forward from game to game, by addition of the introduced coins 23 and by deflection of the existing coins 21 by the action of the pusher 27.

If desired, periodically (predictably or randomly) or following certain predetermined events (such as a jackpot win), the layout may be re-set. Also, if desired, on a predetermined or random basis there may be movements and pay-outs not dictated by the normal game play. For example, coins may be added to the layout, or pay-out may be made which have not been derived from a win. Also, the coins layout may be such that a large 'jackpot' win is periodically available e.g. because the layout includes a relatively large stack.

The machine has been described in relation to one player but if desired provision may be made for two or more players to play from different coin slots, coin runs or other suitable arrangement onto the same playing bed.

It is of course to be understood that the invention is not to be restricted to the details of the embodiment which are described by way of example only for example instead of a touch screen sensor multiple operating buttons may be used to play the game described herein.

The invention claimed is:

1. A video game machine, which comprises:
an electronically operated visual display device;
a control unit including a processor for controlling the electronically operated visual display device;
player controls;
a mechanism for receiving credit or monetary value;
wherein after actuation by introduction of predetermined credit or monetary value said control unit is operable to produce a representation, on the electronically operated visual display device, of an introduced element falling from an upper inlet to a position on a lower playing bed having further elements thereon, and of a pusher movable over said playing bed to cause the introduced element and the further elements to be pushed towards a pay-out outlet, wherein the player controls at least one parameter of fall of the introduced element and, in the event that the position of the introduced element in relation to the further elements results in a representation of one or more elements reaching said pay-out outlet, an award is made available to a player.

2. A machine according to claim 1 characterized in that the player controls comprise push buttons.

3. A machine according to claim 1 characterized in that the player controls comprise a touch screen.

4. A machine according to claim 1 characterized in that the player controls give rise to adjustment of the timing of fall of the introduced element.

5. A machine according to claim 1 characterized in that the player controls give rise to adjustment of the position of fall of the introduced element.

6. A machine according to claim 1 characterized in that there is a representation of a run from which the introduced element falls.

7. A machine according to claim 1 characterized in that there is a fall zone comprising protruding pins.

8. A machine according to claim 1 characterized in that the player can adjust the instant, relative to the movement of the pusher at which the introduced element begins to fall.

9. A machine according to claim 1 characterized in that all the movements occurring on the visual display device are computed and displayed on a simulated real life basis in accordance with gravity and the laws of physics.

10. A machine according to claim 1 characterized in that the pusher is moved backwards and forwards relative to the pay-out outlet.

11. A video game machine, which comprises:
an electronically operated visual display device;
a control unit including a processor for controlling the electronically operated visual display device;
player controls;
a mechanism for receiving credit or monetary value;
wherein after actuation by introduction of predetermined credit or monetary value said control unit is operable to produce a simulated representation, on the electronically operated visual display device, of an introduced element falling from an upper inlet to a position on a lower playing bed having further elements thereon such that an element layout is provided which is periodically re-set in a manner not dictated by normal game play with physical coins, and of a pusher movable over a playing bed to cause the introduced element and the further elements to be pushed towards a pay-out outlet, wherein by operation of the player controls at least one parameter of the simulated fall of the introduced element can be adjusted and, in the event that the position of the introduced element relation to the further elements results in a representation of one or more elements reaching said pay-out outlet, an award is made available to a player.

12. A machine according to claim 11 characterized in that the player controls comprise push buttons.

13. A machine according to claim 11 characterized in that the player controls comprise a touch screen.

14. A machine according to claim 11 characterized in that the player controls give rise to adjustment of the position of fall of the introduced element.

15. A machine according to claim 11 characterized in that the player controls give rise to adjustment of the timing of fall of the introduced element.

16. A machine according to claim 11 characterized in that there is a representation of a run from which the introduced element falls.

17. A machine according to claim 11 characterized in that there is a fall zone comprising protruding pins.

18. A machine according to claim 11 characterized in that the player can adjust the instant, relative to the movement of the pusher, at which the introduced element begins to fall.

19. A machine according to claim 11 characterized in that the pusher is moved backwards and forwards relative to the pay-out outlet.

20. A machine according to claim 11 characterized in that the elements represent flat elements.

21. A machine according to claim 20 characterized in that the falling elements and are represented face-on.

22. A machine according to claim 20 characterized in that the elements situated on the playing bed are represented face-down.

23. A video game machine, which comprises:
an electronically operated visual display device;
a control unit including a processor for controlling the electronically operated visual display device;
player controls;
a mechanism for receiving credit or monetary value;
wherein after actuation by introduction of predetermined credit or monetary value said control unit is operable to produce a representation, on the electronically operated visual display device, of an introduced element falling from an upper inlet through a fall zone, having representations of protruding pins which influence the fall of said introduced elements when a collision between an introduced element and a said pin is displayed, whereby the pat which the introduced element follows is changed by collision with a pin, said introduced element falling to a position on a lower playing bed having further elements thereon, said representation also comprising a pusher moveable over said playing bed to cause the introduced element and the further elements to be pushed toward a pay-out outlet, wherein the player controls at least one parameter or fall of the introduced element and, in the event that the position of the introduced element in relation to the further elements results in a representation of one or more elements reaching said pay-out outlet, an award is made available to a player; and further including a touch screen system which displays said pins whereby, if the player touches at least one image of a protruding pin, said pin no longer deflects an introduced element that collides with it.

24. The video game machine of claim 23 in which the image of a protruding pin appears to retract when touched by said player so that said pin no longer deflects an introduced element that collides with it.

* * * * *